US005326457A

United States Patent [19]

Stipanovich, Jr.

[11] Patent Number: 5,326,457

[45] Date of Patent: Jul. 5, 1994

[54] PROCESS FOR MAKING CARBON ELECTRODE IMPREGNATING PITCH FROM COAL TAR

[75] Inventor: John Stipanovich, Jr., Monroeville, Pa.

[73] Assignee: Aristech Chemical Corporation, Pittsburgh, Pa.

[21] Appl. No.: 925,160

[22] Filed: Aug. 6, 1992

[51] Int. Cl.[5] ..... C10G 9/00; C10G 11/00

[52] U.S. Cl. ..... 208/42; 208/22; 208/39; 208/41

[58] Field of Search ..... 208/42, 41, 22

[56] References Cited

U.S. PATENT DOCUMENTS

| | | | |
|---|---|---|---|
| 2,748,063 | 5/1656 | Radasch | 208/42 |
| 3,010,893 | 11/1961 | Kulik | 208/42 |
| 3,069,347 | 12/1962 | Bole | 208/42 |
| 4,036,603 | 7/1977 | Bernet et al. | 44/13 |
| 4,277,324 | 7/1981 | Greenwood | 208/45 |
| 4,436,615 | 3/1984 | Boodman et al. | 208/39 |
| 4,640,761 | 2/1987 | Mori et al. | 208/44 |
| 4,664,774 | 5/1987 | Chu et al. | 208/39 |
| 4,961,837 | 10/1990 | Velasco et al. | 208/41 |
| 4,986,895 | 1/1991 | Mori et al. | 208/39 |
| 4,997,542 | 3/1991 | Couderc et al. | 208/39 |

FOREIGN PATENT DOCUMENTS

| | | | |
|---|---|---|---|
| 63-130697 | 6/1988 | Japan | C10C 3/14 |

*Primary Examiner*—Helane Myers
*Attorney, Agent, or Firm*—William L. Krayer

[57] ABSTRACT

Carbon electrode impregnating pitch is made from coal tar by centrifugation of the coal tar to remove particulates, followed by milling and distilling the remaining material.

13 Claims, No Drawings

PROCESS FOR MAKING CARBON ELECTRODE IMPREGNATING PITCH FROM COAL TAR

TECHNICAL FIELD

This invention relates to the art of making carbon electrodes for use in the steel and other industries, and particularly to a process for preparing an impregnating pitch for impregnating carbon electrodes, said impregnating pitch being made by the sequential employment of two specific steps before distillation—the centrifugation of a coal tar to remove large particles of quinoline insoluble materials, and the milling of the centrifuged coal tar to reduce the sizes of the remaining quinoline insoluble particles. Contrary to prevailing assumptions, a coal-tar pitch having relatively high quinoline insolubles is thus found to be useful as an impregnating pitch for carbon electrodes.

BACKGROUND OF THE INVENTION

The commercial carbon industry manufactures graphite electrodes that are used in electric-arc steelmaking furnaces. These carbon artifacts must carry large electric currents in the steel melting processes. The desirable characteristics of these carbon electrodes are high density, high modulus of elasticity, high electrical conductivity and high flexural strength.

Such electrodes are typically made by mixing petroleum coke with coal-tar pitch having a high solids content including many particles greater than 10 microns, known as binder pitch. The mix is extruded to form a cylinder known as a "green form", which is baked at 900°–1300° C. to volatilize and remove non-carbonaceous material. When the green form is baked, it is transformed from a product which contains about 95% carbon to one which contains greater than 99% carbon. During the baking process, some of the organic compounds are destructively distilled, resulting in carbon deposition in the form. As the vaporized materials vacate their specific locations and exit the form, they produce a porous and channeled structure, resulting in a reduced density and reduced capacity of the form for carrying current. Impregnating pitches are used to fill the pores and channels to increase the carbon density of the form and thus improve the current carrying capacities of the electrode. After impregnation, the form is baked again and then graphitized at temperatures as high as 3000° C.

In the prior art, impregnation required a pitch having a low content of solids greater than about 1 micron in size. Petroleum pitch has been most frequently used in the past because it is relatively free of solid particles; if coal-tar pitch is used, it must have a low solids content to pass the filterability test. Solids content of coal-tar pitch is generally expressed in terms of quinoline insolubles, or "QI", because the particulate matter in coal-tar pitch is largely particles of coal, coke and carbon, which are insoluble in quinoline, while the balance of the pitch is soluble.

More particularly, there are five characteristics normally used to guide the choice of a coal-tar impregnating pitch. These are:

1. Softening point, usually as measured by ASTM D3104. This test gives an indication of pitch viscosity at impregnating conditions.
2. Quinoline Insolubles, (QI), usually is measured by ASTM D2318. This test provides a measure of the coal, coke, and carbon particles in the pitch as well as any liquid crystals that may have formed if the pitch was heat-treated.
3. Ash, usually as measured by ASTM D2415. This test gives an indication of materials that may be left in the electrode that may catalyze carbon loss under ultimate use conditions.
4. Coking value, usually as measured by ASTM D2416. This test gives an indication of how much in-situ carbon will be deposited from the impregnating pitch in the electrode.
5. Rate of filtration and filterability index as measured by any suitable process, which may be similar to that described by Couderc et al in U.S. Pat. No. 4,997,542, column 1, lines 40–65, incorporated herein by reference. Generally, filterability indices of 2.5 $g^2$/min. or greater are considered acceptable for an impregnant.

Because of its extremely low solids content and high filterability index, petroleum pitch is normally utilized as the impregnating pitch. However, petroleum pitch has a lower in-situ carbon yield than coal-tar pitch and yields a more non-uniform deposition of its carbon. Coal-tar pitch generally has a lower filterability index because of the coal and coke particles contained therein and is usually subjected to the expensive step of solids removal to make a suitable impregnant.

The present invention enables the economic use of coal-tar pitch as the impregnant for green form electrodes.

As mentioned above, it has been known in the past to use petroleum pitch as an impregnant for carbon electrodes. See U.S. Pat. Nos. 4,961,837 and 4,277,324. These patents of course do not address the problem solved by applicant, which is to prepare a coal-tar pitch economically for such use.

The basic objective of the Couderc et al patent mentioned above (U.S. Pat. No. 4,997,542) is to make a pitch having minimal QI. The present invention has as its object the opposite, in the sense that the quinoline insoluble materials are preserved in the pitch insofar as possible or practical. Couderc et al employ a thermal treatment and flash distillation, and do not centrifuge as does the present invention.

A relatively simple centrifugation of coal tar is shown by Bernet et al in U.S. Pat. No. 4,036,603. While the description says the liquid product is "substantially solid-free" (column 1, line 54), no use is suggested for it, and very likely it would be unsuitable as an impregnation pitch because of residual particles greater than one micron.

Boodman et al, in U.S. Pat. No. 4,436,615, prepare a coal-tar pitch which is proposed for making electrodes. They filter as well as centrifuge, and optionally distill liquids from the separation steps to make a product suggested for impregnating graphite electrodes (column 3, line 68–column 4, line 1).

Mori et al, in U.S. Pat. No. 4,640,761, use a heat-treating step prior to centrifugation to cause aggregation of relatively small particles of quinoline insolubles so they can be more easily removed; in Mori et al U.S. Pat. No. 4,986,895, two centrifugation steps are used with heat treatment between them to cause aggregation of the smaller quinoline insolubles to facilitate centrifugation.

A low QI impregnating pitch is made by Chu et al in U.S. Pat. No. 4,664,774. They use an oxidation system with no resemblance to applicant's.

The only reference of which I am aware utilizing milling actually mills coal-tar pitch rather than coal tar. This is Japanese Patent 63,130,697 (Jun. 2, 1988), which made a pitch capable of impregnating graphite electrodes having a porosity of 17%. The process is not like applicant's, which combines the steps of centrifugation and milling.

SUMMARY OF THE INVENTION

Unlike many workers in the art who want to completely remove the quinoline insolubles from the pitch, applicant tolerates a significant amount (1 to 15 wt. %) of quinoline insolubles, and is able to do so because of the important milling step after centrifugation. Applicant's process comprises centrifuging a coal tar to remove particles greater in size than about 15 microns and milling the remainder to achieve a product suitable for green form impregnation, having a QI of at least about 3 wt. % which is due to the presence of solid particles having an average size no greater than about 1 micron. The milled material is then distilled to produce a coal-tar pitch useful for impregnating carbon electrodes.

DETAILED DESCRIPTION OF THE INVENTION

The centrifuging can be conducted in any suitable centrifuge of the type which will cause a separation between the large and small particle size solids materials. A solid-bowl type centrifuge is preferred.

The viscosity of the coal tar during centrifuging is maintained by controlling the temperature of said coal tar and/or the amount and type of diluent mixed with said coal tar. Desirable diluents, if used, include lighter fractions of coal tar, such as creosote. The viscosity of the coal tar during centrifugation is preferably maintained below about 400 SUS (Saybolt Universal Seconds), and more preferably between about 100 and about 200 SUS. The viscosity of the coal tar during centrifugation may also be controlled by varying temperature. Preferably the coal tar temperature is maintained between about 140° F. and about 325° F., and more preferably between about 200° F. and about 300° F.

The small particle size material generally has an average size of less than about 10 microns, whereas the large particle size solids generally has an average particle size greater than about 10 microns. The speed of the centrifuge, residence time, and other conditions will be varied depending upon the type of coal tar, viscosity of the coal tar, and other characteristics of the coal tar in order to get the desired separation. The centrifuge should be operated to produce an acceleration of at least 1000 times that of the earth's gravity.

After centrifugation, the centrate is transferred to a mill. The mill is of a type wherein a vessel containing grinding media having diameters of about 0.4 to about 5 millimeters is equipped with a suitable motor driven rotor for agitation. Such a mill is sold by Epworth Manufacturing Co., Inc. The effluent from the mill is distilled conventionally to produce an impregnating pitch of the desired softening point. The centrate from the centrifuge is transferred to the mill (or series of mills) which is then operated continuously or intermittently to grind the tar, until the solids contained in the tar are reduced to less than 1 micron in diameter.

I have found that the process is far more efficient than otherwise if the grinding media have diameters no greater than 1 millimeter in the final stage of grinding.

Examples of my process follow:

Debenzolized coal tar at 205° F. was fed to a solid-bowl centrifuge at 50 gallons per minute. The centrifuge was operated to produce an acceleration 2100 times that of earth's gravity at the bowl wall. The yield of centrate was 96.3 volume %. Analysis of the feed and products are as follows:

| | Ash, wt. % | Quinoline Insolubles, wt. % |
|---|---|---|
| Feed | 0.22 | 8.1 |
| Centrate | 0.08 | 7.2 |
| Underflow | 2.96 | 35.6 |

A sample of the centrate was milled in a one-gallon Mini-Lab SWMILL made by Epworth Manufacturing Co., Inc. of South Haven, Mich. The mill was operated at 2500 rpm. Equal volumes of centrate and 0.8 mm diameter steel shot were charged to the mill. The centrifuged coal tar was milled for 12 hours while controlling the outside of the milling chamber to approximately 80° C. At the end of the run, creosote was added to the mix of media and tar to facilitate straining the media from the tar. The amount of creosote added was 10 wt. % of the milled tar.

The media-free milled tar and creosote were subjected to a simple side-arm distillation at 100 mm Hg absolute overhead pressure and a final pot temperature of 335° C. to produce a pitch with a Mettler softening point of 109.9° C. This pitch was then tested for filterability at 225° C. and a filterability index of $>10,000$ $g^2$/min. was obtained.

I claim:

1. Method of making a coal-tar pitch suitable for impregnating a carbon form comprising (1) centrifuging a coal tar at a viscosity less than 400 Saybolt Universal Seconds to remove at least 75% of the solids therein greater than 15 microns, (2) milling the centrifuged coal tar with milling media less than 5 mm in diameter, and (3) distilling the milled tar to produce a coal-tar impregnating pitch.

2. Method of claim 1 wherein a diluent is added to the coal-tar pitch to obtain a viscosity less than 400 SUS.

3. Coal-tar pitch made by the method of claim 2, useful for impregnating incipient carbon electrodes, said pitch being substantially free of solid particles greater than about 1 micron, and having a Quinoline Insolubles content of at least about 3 weight percent.

4. Method of claim 1 wherein the centrifuging step is conducted to produce an acceleration at least 1000 times earth's gravity.

5. Coal-tar pitch made by the method of claim 3, useful for impregnating incipient carbon electrodes, said pitch being substantially free of solid particles greater than about 1 micron, and having a Quinoline Insolubles content of at least about 3 weight percent.

6. Method of claim 1 including maintaining the temperature during the centrifuging and milling steps between about 140° F. and about 325° F.

7. Coal-tar pitch made by the method of claim 4, useful for impregnating incipient carbon electrodes, said pitch being substantially free of solid particles greater than about 1 micron, and having a Quinoline Insolubles content of at least about 3 weight percent.

8. Method of claim 1 wherein the milling is carried out in two or more stages with reduced sizes of milling media in each stage.

9. Coal-tar pitch made by the method of claim 5, useful for impregnating incipient carbon electrodes, said pitch being substantially free of solid particles greater than about 1 micron, and having a Quinoline Insolubles content of at least about 3 weight percent.

10. Method of claim 1 wherein the milling of step (2) is conducted until solids greater than 1 micron in diameter contained in the tar are reduced to less than 1 micron in diameter.

11. Coal-tar pitch made by the method of claim 10, useful for impregnating incipient carbon electrodes, said pitch being substantially free of solid particles greater than about 1 micron, and having a Quinoline Insolubles content of at least about 3 weight percent.

12. Coal-tar pitch made by the method of claim 1, useful for impregnating incipient carbon electrodes, said pitch being substantially free of solid particles greater than about 1 micron, and having a Quinoline Insolubles content of at least about 3 weight percent.

13. Coal-tar impregnating pitch substantially free of solid particles greater than about 1 micron, said coal-tar impregnating pitch having a Quinoline Insolubles content of at least about 3 weight percent.

* * * * *